US005307928A

United States Patent [19]

Bishop

[11] Patent Number: 5,307,928

[45] Date of Patent: May 3, 1994

[54] SIX PIECE APPLIANCE PACKAGE

[75] Inventor: Richard E. Bishop, Weston, Ontario, Canada

[73] Assignee: Domtar Inc., Montreal, Canada

[21] Appl. No.: 13,672

[22] Filed: Feb. 3, 1993

Related U.S. Application Data

[63] Continuation of Ser. No. 817,716, Jan. 7, 1992, abandoned.

[51] Int. Cl.[5] ..... B65D 85/00

[52] U.S. Cl. ..... 206/320; 206/497; 206/586; 206/597

[58] Field of Search ..... 206/320, 386, 586, 597, 206/497; 414/607

[56] References Cited

U.S. PATENT DOCUMENTS

| | | | |
|---|---|---|---|
| 1,786,189 | 12/1930 | Bowersock | 206/586 |
| 2,340,387 | 2/1944 | Hummel | 206/320 X |
| 2,575,784 | 11/1951 | Baumann | 206/320 |
| 3,023,919 | 3/1962 | Hobson | 414/607 |
| 3,072,313 | 1/1963 | Svendsen | 206/586 |
| 3,504,842 | 4/1970 | Grafslund | 206/320 X |
| 3,734,389 | 5/1973 | Brown | 206/586 |
| 3,835,986 | 8/1974 | Le Beau | 206/320 |
| 3,891,086 | 6/1975 | Isaacs | 206/320 |
| 4,226,327 | 10/1980 | Ballard | 206/320 |
| 4,610,355 | 9/1986 | Maurer | 206/386 |
| 4,717,025 | 1/1988 | Maurer | 206/586 X |
| 4,811,840 | 3/1989 | Muyskens | 206/320 |
| 4,881,641 | 11/1989 | Mattingly | 206/320 |
| 4,919,263 | 4/1990 | Baltzer et al. | 206/586 X |
| 4,955,474 | 9/1990 | Mattingly | 206/320 |
| 5,161,692 | 11/1992 | Knierim | 206/586 |

OTHER PUBLICATIONS

Acknowledge prior art described in the Information Disclosure Statement received Apr. 14, 1992.

*Primary Examiner*—Bryon P. Gehman

*Attorney, Agent, or Firm*—Griffin, Butler, Whisenhunt & Kurtossy

[57] ABSTRACT

A container for shipping household appliances such as refrigerators, stoves, washers, dryers and the like comprises six separate pieces. The pieces include a top cap, a separate bottom support which may also be in the form of a cap and four separate corner posts which form the package the appliance is placed on or within the bottom support or cap. The four corner posts are then placed on the four corners of the appliance and the top cap is then placed over the appliance and the four corner posts. Two tensile straps are then fastened around the package. Each tensile strap passes around the top and bottom and along two of the corner posts. Optionally, where the package is of the BASILOID flange type a third strap may be passed horizontally around the top to provide the support for that flange. Optionally the package, with or without the BASILOID type flange may be over-wrapped with film or enclosed in a clear bag to provide a package which is open on all sides and through which the appliance contained within may be viewed during handling.

8 Claims, 6 Drawing Sheets

SIX PIECE APPLIANCE PACKAGE

This application is a continuation of Ser. No. 07/817,716, filed Jan. 7, 1992, now abandoned.

FIELD OF THE INVENTION

This invention relates to improvements in boxes of the type in which appliances such as stoves, fridges, washers, dryers and the like are shipped from the manufacturer to the retailer.

In particular the invention relates to appliance packages in which the appliance is visible within the package and in which the amount of corrugated fibre board or other material from which the container may be manufactured is reduced as compared to a conventional box.

Conventionally appliances such as refrigerators, stoves, washers, dryers, dishwashers and the like have been packaged in corrugated fibre board containers. The container traditionally is a six sided rectangular box suitably large that the appliance can be placed within the container in an upright position for shipment. Once packaged within the container the appliance is no longer visible. The complete surrounding of the appliance by the packaging material helps to prevent damage to the appliance during transit. Another of the functions of typical packaging is support for stacked units. It is often desirable to be able to stack the appliances in a warehouse or the like. The compressive loads generated during stacking can be passed downwardly either by loading the weight on the appliance itself or by building reinforced structures in the package which can communicate the load to the next lower package and ultimately to the pallet or warehouse floor.

While existing packaging is quite successful in protecting appliances during transit, more recent and modern demands are changing the packaging requirements substantially. While the concept of totally protecting a package completely on all sides was thought to lead to the most damage free handling of packages it has now become apparent that removing the appliance from view in the package may be counterproductive. If the appliance is visible within the package then if any damage is done during transit that damage is immediately apparent. This in fact leads to the conclusion that where the appliance is at least partially visible within the package the incidence of damage is lessened. To this extent the traditional packaging has been modified in certain circumstances to provide windows in one or more of the sides of the package so that the appliance contained therein will be visible through the window.

Another requirement has arisen more recently. This is the general overall desirability of reducing the amount of corrugated fibre board packaging. When the package is discarded, the corrugated fibre board material must be either recycled or sent to landfill projects or the like. There is now a strong demand to reduce the amount of corrugated fibre board. Accordingly, it is desirable that such packages be further modified to reduce the amount of corrugated fibre board material necessary to safely package and protect the appliance during transit.

In accordance with one embodiment of this invention an appliance package comprises a separate top cap, a separate bottom support or cap and four separate corner posts. The six separate pieces are assembled around the appliance. The integrity of the package is then completed by assembling at least two tensile straps around the assembled package. Each of the tensile straps extends across the top and bottom and adjacent two of the corner posts. In a preferred embodiment of the package the open spaces comprising the sides of the package between the corner posts are covered with a transparent film.

In an other embodiment a third horizontal strap is passed around the top cap providing structural support and integrity in order that the package may be handled using a forklift truck and a BASILOID-type flange which may be part of the top cap itself.

Other aspects of the invention can be understood from reference to the following drawings which illustrate a preferred embodiment of the invention and in which.

Figure 1:
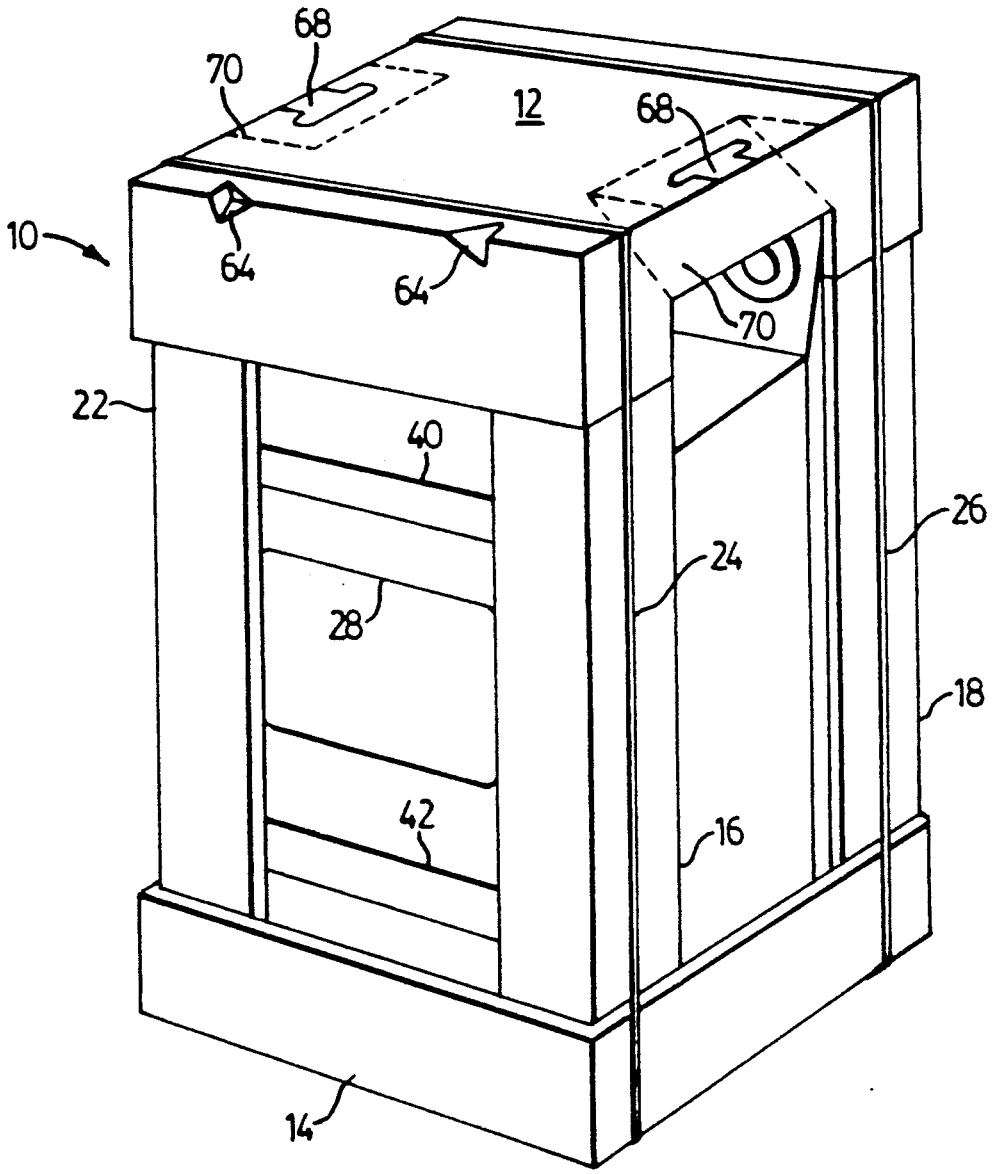
FIG. 1 is a perspective view of an appliance packed within an appliance package in accordance with the invention.

The assembled package 10 is illustrated in FIG. 1. The assembled package comprises a top cap 12, a separate bottom support which in this preferred embodiment is in the form of a cap 14 and four separate corner posts, 16, 18, 20 and 22. The assembled package also comprises tensile straps 24 and 26.

As illustrated in FIG. 1, the sides of the package between the corner posts remain open so that the appliance 28 contained within the package is visible on all four sides.

In order to assemble the package as shown in FIG. 1 the bottom cap 14 is first loaded on to the assembly station. The appliance 28 can then be placed on or within the bottom cap. After placement of the appliance 28 the four corner posts can be inserted within the bottom cap. After assembly of the four corner posts the top cap is laid over the four corner posts and above the appliance 28. Thereafter the tensile straps 24 and 26 may be applied to the package.

The tensile straps 24 and 26 may be made of polyester, spring steel or the like. These straps are loaded in tension and give the package its integrity. Each strap extends across the top and bottom caps and along one leg of each of two of the corner posts. These straps are applied vertically. In FIG. 1 strap 24 extends across the top cap 12, the bottom cap 14 and along the two corner posts 16 and 22. The strap 26 similarly extends along the top and bottom caps and along the two corner posts 18 and 20. It does not matter whether the two straps are arranged so that one covers the two front posts and the other covers the two rear posts or whether the straps are arranged so that one covers the two posts on the left side while the other covers the two corner posts on the right side. This is clearly a matter of choice to the appliance packager and may depend on other features.

The purpose of the two straps is to give the package integrity. By placing the straps along the corner posts as indicated, the tensile stress in the straps is transferred directly to the corner posts. The straps need not be directly on the posts, although this is clearly the preferred position. The straps may however be placed adjacent the corner post. It is not desirable, however, to place the straps centrally of the sides as this requires the tensile forces to pass to the top and bottom caps, which in turn must act like beams to transfer the stress to the corner posts. This would require strengthening of the cap or caps or insertion of additional bracing material which is not desirable.

Figure 2:
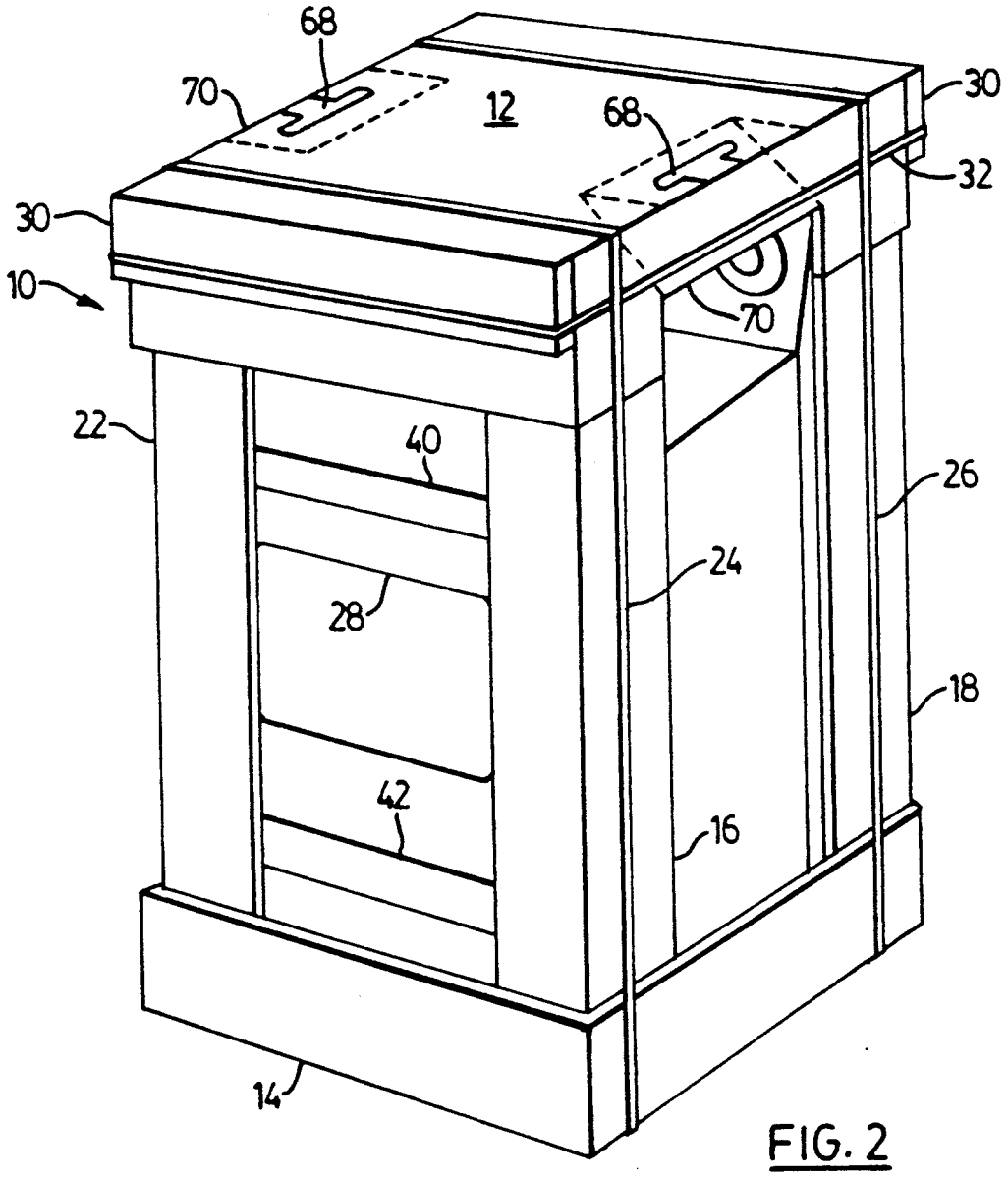
FIG. 2 is a perspective view similar to FIG. 1 showing a further embodiment.

In one embodiment of the invention as shown in FIG. 2 the top cap 12 has been provided with a flange 30 of the type referred to as a BASILOID-flange for handling. The BASILOID-flange involves a vertical projection behind which the corresponding vertical tang of a lift truck may grasp the package. In order to provide for the structural integrity required for a flange of this type a horizontal strap 32 is passed around the skirt of the top cap to provide the necessary integrity. This strap 32 is a tensile strap and may be manufactured of the same material as the straps 24 and 26.

Figure 3A:
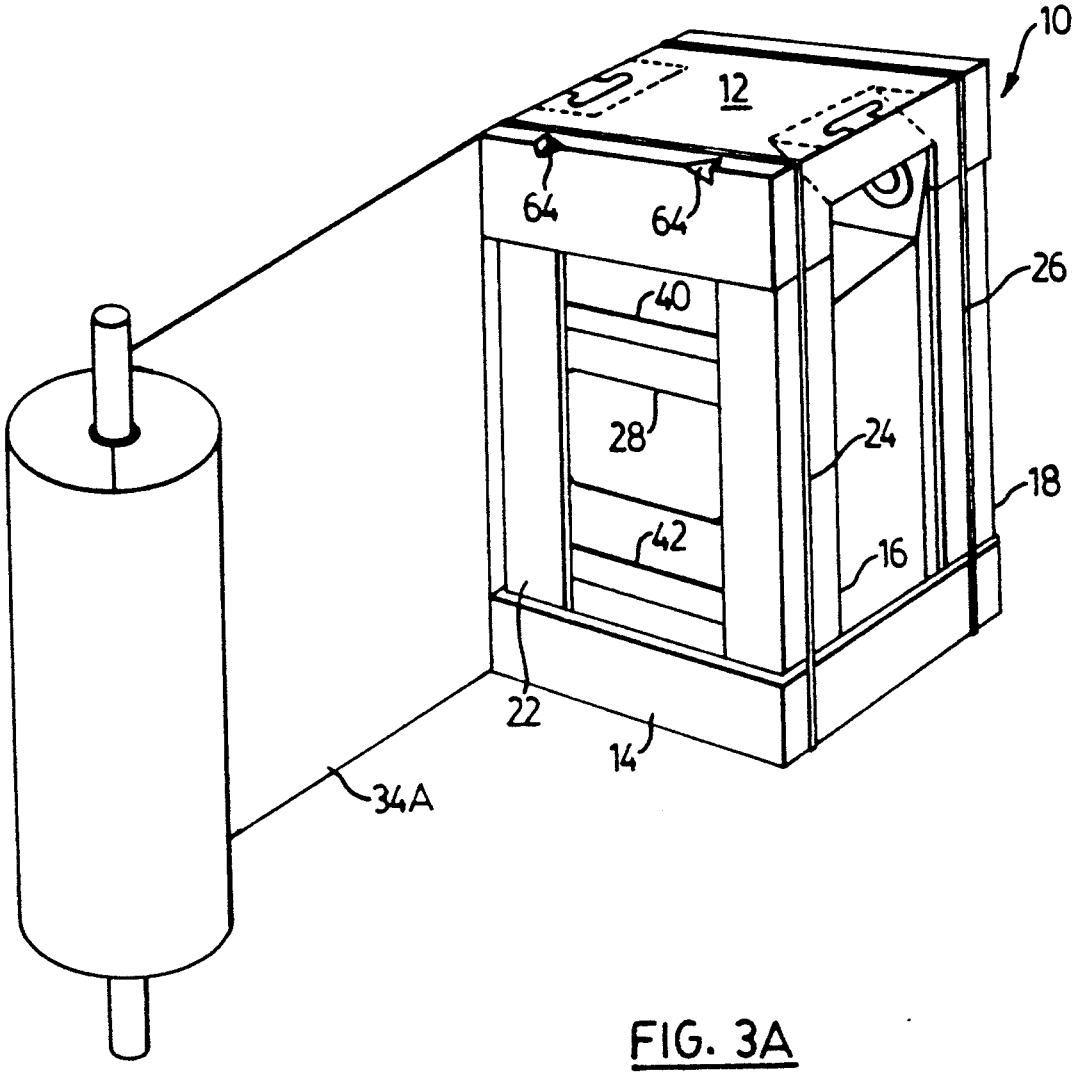
FIGS. 3A and 3B illustrates transparent coverings which may be used with the package of FIG. 1.
Figure 3B:
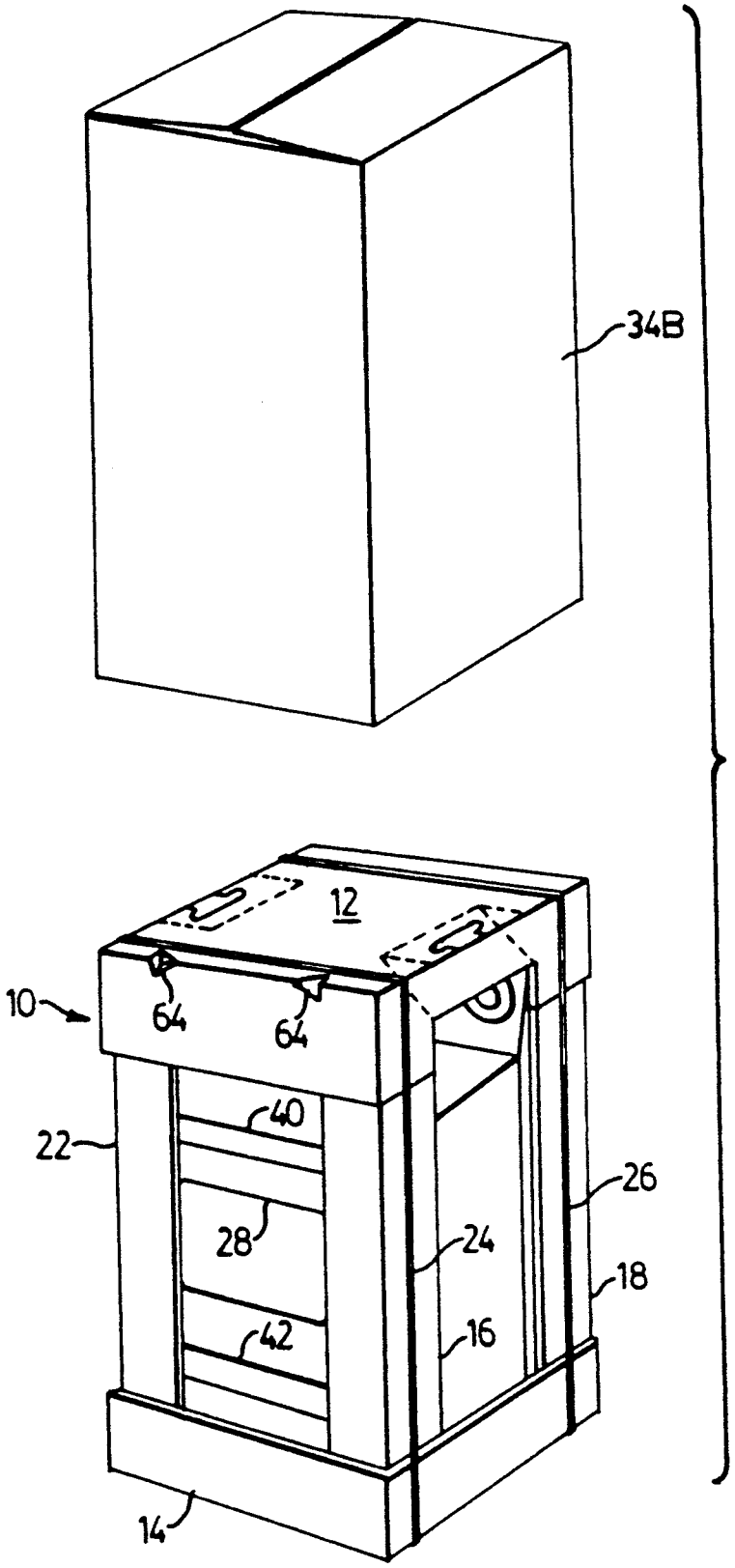

The package as illustrated in FIG. 1 is complete and may be used to transport the appliance from manufacturer to distributor and on to the retailer. Where, however, it is desired to provide further protection to the appliance such as from dust and the like during warehousing, it may be desirable to ensure that the open sides of the package are covered by a transparent material. Such a transparent material is illustrated in FIGS. 3A and 3B. The transparent material may involve a shrink wrap or a stretch film wrap 34A. The wrap may be applied to the package after the package has been completed as shown in FIG. 1. If a shrink wrap film or the like is used the wrap may be passed around the sides of the package and sealed to itself in the standard manner. The transparent film will extend around the packaging overlying at least the open areas between the posts. An alternative is to use a transparent five sided bag 34B which may be slipped over the assembled appliance package with the open edges of the bag then being sealed to one of the caps. This then provides a sealed package in which dust and the like cannot damage the appliance during transit.

Certain kinds of appliances require special handling and packaging aspects. One example is an electric or gas stove. The front surface of this type of appliance is relatively planar except that there is normally provided a handle extending across the width of the appliance so that the user may open the oven door by grasping the handle. This type of appliance provides some problems in packaging. Normally the corner posts will bear upon the outermost surface of the appliance. In this case where the handle protrudes out beyond the surface of the appliance it is often desirable to provide so-called standoff pads to provide support and protection for those handles. Such a standoff pad 40 is illustrated in FIG. 1 encompassing the handle of an appliance 28 which in this case is a stove. A further standoff pad 42 is shown in FIG. 1 extending across the lower extremity of the stove. This pad may protect a service drawer or the like. The standoff pads advantageously bear against two corner posts to form a beam. The beam will give protection to the appliance where needed and will also serve to brace the two corner posts against any deflection toward one another.

Figure 4:
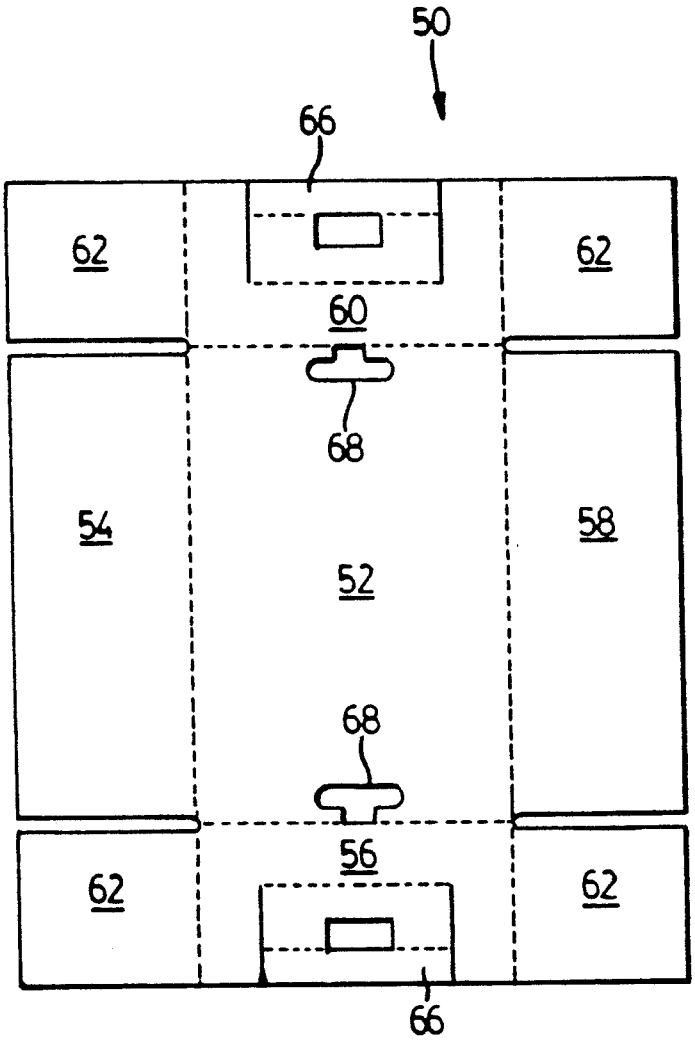
FIG. 4 is a plan view of a blank from which a component of the package of FIG. 1 may be made.

All of the components of the packaging other than the straps may advantageously be manufactured from corrugated fibre board. The top cap 12 and bottom cap 16 may be essentially similar. The caps may be manufactured from a blank 50 as shown in FIG. 4. The blank comprises a central surface 52 which will form the top or bottom of the appliance package. Arranged around the edges of the blank are flaps 54, 56, 58 and 60 which comprise the skirt portions of the cap. Skirt portions 56 and 60 also have corner flaps 62 which when folded provide the corner closure. The blank 50 may be folded to comprise the top or bottom cap at the appliance manufacturer or at the box maker. Advantageously the product is shipped flat and then assembled at the appliance maker. The product may be shipped fully glued but in knock-down state to be erected by the appliance maker. Alternatively, various means may be used to convert the blank to the cap in the premises of the appliance maker. The corner tabs 62 may be glued to the skirts 54 and 58 by means of glue. Typically this will involve glue being applied at at least four points for each cap. It is also possible of course to constitute corners by using standard lock tabs in conjunction with the corner tabs 62. All of these methods are easily usable with the package of the present invention.

In some cases, the bottom cap may be in the form more generally of a bottom support. The bottom support may be comprised of a pallet-like structure or other support which may be attached to the bottom of the appliance during manufacture and/or during shipping. Such a support structure may be utilized in place of a corrugated cap discussed above. Such a support may require modification to contain the corner posts as discussed above. This may require the addition of a skirt around the perimeter of the support structure if the structure is like a pallet. Alternatively, the bottom support could be in the form of a moulded plastic base.

Figure 5:
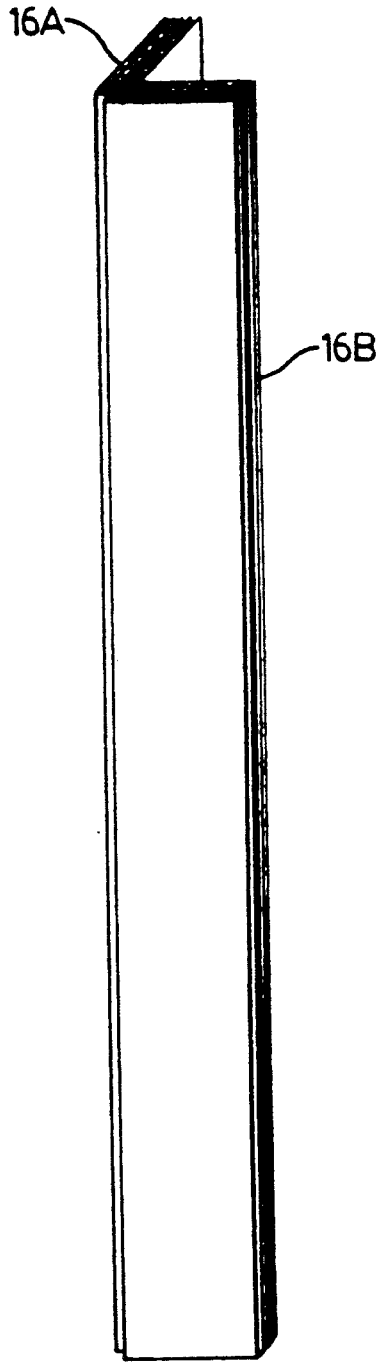
FIG. 5 is a perspective view of another component of the package of FIG. 1.

The corner posts may be advantageously manufactured from corrugated fibre board material. Typically the corner post as shown in FIG. 5 comprise two substantially equal legs 16A and 16B forming a substantially 90° angle. The corner posts may be provided with several layers of corrugated fibre board construction. The number of layers is a factor of both the standoff distance required and the strength of the corner post. When the package is assembled the interior surface of the corner post will bear against the exterior surfaces available of the appliance 28 in the vicinity of the corner post. Corner posts may be shipped flat from the box maker pre-scored so that they may be folded to the 90° configuration at the appliance maker if this is desired.

Other unique problems arise with appliances of the type such as stoves, washers and dryers. Typically such appliances have a relatively flat top surface except at the rear portion. Often there is an upstanding control panel at the rear. The control panel then defines the overall height of the appliance. This in turn means that corner posts pressing against the rear of the appliance are in full contact with the appliance from the base to the uppermost portion of the control panel. Corner posts applied at the front of such an appliance must extend above the upper surface of the appliance a distance of several inches representing the height of the rear control panel. At this point the post is not bearing against the appliance. In certain circumstances where the appliances are intended to be stacked several high or are themselves particularly heavy, the fact that the corner posts are not supported from collapsing inwardly at the upper extremity can lead to problems.

FIGS. 1 and 4 illustrate a top cap 12 in which additional reinforcements are incorporated to protect against the corner posts collapsing inwardly. It is to be realized that the corner posts cannot collapse outwardly as they are restrained by the tensile straps 24 and 26.

In the example illustrated in FIGS. 1 and 4 two different types of support are provided. At the front of the appliance so-called triangular pop-ins 64 are provided to support the edge of the corner post at the front of the appliance. The triangular pop-ins provide a bearing surface for one edge of the corner post so that the corner posts are supported in that horizontal direction.

Another reinforcement means is shown on the sides. In this case the skirts 56 and 60 are provided with a scored and slit tab 66. The tab may be folded upon itself and glued or interlocked with a lock tab 68 in surface 52. This then provides a triangular brace 70 extending angularly from the skirts 56 and 60 to the surface 52. The triangular brace 70 can serve two functions. Firstly, it may serve as the horizontal support to prevent the corner posts from deflecting toward each other under load. Secondly, the triangular brace provides a support beam which will stiffen the surface 52.

In accordance with the appliance package of this invention, the use of corrugated fibre board material is reduced to the minimum amount required to provide structural integrity for the package. The corner posts may have legs as short as structural limitations dictate. The top and bottom caps provide a substantially integral flat surface which may be used for stacking the appliances in a warehousing operation. The remainder of the package remains open on all sides to prompt careful handling during transit while still being capable of being closed by a transparent film where dust protection and the like is desired.

It will be obvious to those skilled in this art that various modifications and changes may be made such as by altering the number or orientation of the straps without departing from the essential features of the invention as defined in the following claims.

I claim:

1. A package for a generally rectangular appliance having four vertical corners, said package having separate components and comprising:

(1) a four-cornered, generally rectangular, separate bottom support;

(2) a separate, uniformly right-angled corner post vertically disposed at each corner of the bottom support and each corner post vertically extending generally along a corner of a rectangular appliance received between the corner posts and above the bottom support such that the corner posts bear against the appliance corners and wherein the corner posts extend above an uppermost surface of the appliance a distance sufficient that the weight of a similarly packaged appliance stacked on said package is substantially carried by the corner posts;

(3) a four-cornered, rectangular separate top cap disposed on the corner posts at the corners of the top cap;

(4) a first tensile strap extending across the top cap, over first and second of said corner posts and under said bottom support and a second tensile strap extending across the top cap, over third and fourth of said corner posts and under said bottom support such that the said tensile straps transfer a tensile stress induced therein directly to the corner posts; and wherein said corner posts are made of fiber board sufficient to allow said stacking without substantial crushing of the corner posts and the tensile straps are made of a material sufficient to allow the package to be vertically lifted from near the top cap thereof without separating said components thereof, and wherein the package has open side walls between adjacent corner posts.

2. The package of claim 1, further comprising substantially transparent wrapper material extending around said package and overlying at least the areas of said package between adjacent ones of said corner posts.

3. The package of claim 1, comprising a third tensile strap extending around said top cap and said top cap comprising a vertically extending flange spaced from the side of said package to permit handling of said package by a lift mechanism adapted to insert a vertically extending plate to engage said flange.

4. The package of claim 1, further including at least one standoff pad adapted to bear against one or more of said corner posts and against an appliance disposable therein.

5. The package of claim 4, wherein at least one standoff pad extends between at least two of said corner posts to create a beam providing protection in the area between said posts and bracing said posts against inward deflection.

6. The package of claim 1, wherein said top cap further comprising an upper surface and four skirt portions extending substantially vertically, at least one of said skirt portions comprising a folded reinforcing flap, said flap being folded to comprise a triangular brace with said upper surface and said at least one skirt portion, said flap extending between two of said corner posts whereby said flap reinforces said top cap and limits deflection of said posts toward one another.

7. The package of claim 1 wherein at least said top cap and each of said corner posts comprise fibre board material.

8. An appliance package comprising a separate top cap, a separate bottom support and four separate corner posts, a first tensile strap extending across said top cap, said bottom support and adjacent first and second of said corner posts and a second tensile strap extending across said top cap, said bottom support and adjacent the third and fourth of said corner posts, said top cap further comprising an upper surface and four skirt portions extending substantially vertically, at least one of said skirt portions comprising a folded reinforcing flap, said flap being folded to comprise a brace with said upper surface and said at least one skirt portion, said flap extending between two of said corner posts whereby said flap reinforces said top cap and limits deflection of said posts toward one another.

* * * * *